US006624556B1

(12) United States Patent
Ono

(10) Patent No.: US 6,624,556 B1
(45) Date of Patent: Sep. 23, 2003

(54) FE-NI ALLOY USED FOR A SHADOW MASK AND A METHOD FOR PRODUCING A SHADOW MASK

(75) Inventor: Toshiyuki Ono, Kanagawa (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 0 days.

(21) Appl. No.: 09/266,029

(22) Filed: Mar. 11, 1999

(30) Foreign Application Priority Data

Mar. 20, 1998 (JP) ..... 10-092616

(51) Int. Cl.[7] ..... H01J 29/80; C22C 38/08
(52) U.S. Cl. ..... 313/402; 313/407; 148/625
(58) Field of Search ..... 313/402, 403, 313/404, 407, 408; 148/625, 628, 631, 633; 430/4, 23, 36, 323

(56) References Cited

U.S. PATENT DOCUMENTS 5,532,088 A * 7/1996 Teshima et al. ..... 430/4
6,024,809 A * 2/2000 Ono et al. ..... 148/625

* cited by examiner

*Primary Examiner*—Vip Patel
*Assistant Examiner*—Joseph Williams
(74) *Attorney, Agent, or Firm*—Birch, Stewart, Kolasch & Birch, LLP

(57) ABSTRACT

An Fe-Ni alloy having improved softening property is provided consisting of from 34 to 38% of Ni, not more than 0.5% of Mn, from 0 to 0.02% of soluble Al, from 0.005 to 0.0100% of N, the balance being Fe and unavoidable impurities. A smaller of the first value, which is the content of the soluble Al content divided by 27, or a second value, which is the nitrogen content divided by 14, is not more than 0.00015. When the first value and the second value are the same, the soluble Al content is from 0 to 0.01%.

14 Claims, 3 Drawing Sheets

FE-NI ALLOY USED FOR A SHADOW MASK AND A METHOD FOR PRODUCING A SHADOW MASK

BACKGROUND OF INVENTION

1. Field of Invention

The present invention relates to an Fe-Ni alloy used for a shadow mask and a method for producing a shadow mask. More particularly, the present invention relates to an Fe-Ni alloy used for the shadow mask of Braun tube, which is produced by fine photo-etching of an Fe-Ni alloy sheet for piercing, annealing and bending by means of warm pressing. The present invention particularly improves the softening property of an Fe-Ni alloy sheet, when it is annealed at a temperature of 800° C. or more before the press-forming.

2. Description of Related Art

FIG. 1 is a cross-sectional view of the known shadow-mask type color cathode-ray tube. A fluorescent coating 2 is applied on the panel 1 and emits three primary colors, i.e., red, green and blue. An electron gun 4 is provided in the neck of the cathode-ray tube and emits electron beams 3. The electron beams 3 are deflected and scanned by the deflecting yoke 5. Reference numerals 6 and 7 denote the shadow mask and the magnetic shield, respectively.

Referring to FIG. 2, an enlarged partial view of the shadow mask 6 is shown. The electron beams from the red, green and blue electron guns 4*a*, 4*b* and 4*c* pass through one of the apertures 9 of the shadow mask 6 and then energizes the fluorescent dots 10.

Heretofore, aluminum-killed steels have been used for the shadow mask of a Braun tube. An Fe-Ni alloy referred to as a 36 alloy or Invar is used for a high-grade device from the point of view of color purity, because its thermal expansion is low and its gas emission upon exposure to high vacuum or electron impingement is minimal.

Photo-etching is generally used for piercing the apertures 9 through the shadow mask 6, from the viewpoint of dimension accuracy. A warm press is used for bending the Fe-Ni alloy into a curved shape of the panel 1. The Fe-Ni alloy must exhibit two properties. One property is etching property such that apertures 9 are pierced by etching with the pitch and area size exactly as designed. The other property is press formability such that the sheet is bent exactly as designed.

In order to meet the above mentioned etching property, there are various proposals to decrease the non-metallic inclusions in the Fe-Ni alloy. There is a proposal in Japanese Unexamined Patent Publication (kokai) No. 7-48651 to decrease the oxygen content and the amount of oxide inclusions so as to improve the press formability.

In order to decrease the amount of oxygen, expensive refining method, for example a two-stage refining such as the preliminary, vacuum melting or ladle refiing and the secondary re-melting by vacum arc melting or electroslag melting, becomes necessary. Such method may be not be feasible industrially.

There is a proposal in Japanese Unexamined Patent Publication (kokai) No. 9-324244 that the size of non-metallic inclusions in an Fe-Ni alloy is controlled by means of accelerating the cooling rate in a temperature range of from 1100° C. to 700° C., when it is hot-rolled from the hot-rolling temperature-range prior to the subsequent cold-rolling step. As a result, the softening temperature is lowered to a level lower than that attained heretofore. In order to implement such controlled cooling, a cooling equipment and electric power for the cooling equipment are necessary. In addition, the present inventors discovered that the etching property of the so-controlled cooled Fe-Ni alloy sheet is not improved in a case the Al content of such sheet is high.

SUMMARY OF INVENTION

It is an object of the present invention to provide an Fe-Ni alloy used for a shadow mask, having improved etching property and press formability.

It is another object of the present invention to provide a shadow mask made of an Fe-Ni alloy having improved etching property and press formability, which is annealed at a particular range of temperature.

It is a further object of the present invention to provide a method for producing an Fe-Ni alloy used for a shadow mask, in which the previously proposed methods, i.e., the special refining and melting method and the accelerated cooling, are unnecessary.

The present inventors considered various ways to improve the etching property and discovered that the etching property is further improved with higher N content of the Fe-Ni alloy. The present inventors quantitatively analyzed the influence of Al and Mn upon the etching property. As a result of these findings and analysis, the following Fe-Ni alloy for a shadow mask is provided.

In accordance with an object of the present invention, there is provided an Fe-Ni alloy used for a shadow mask, consisting of, by weight percentage, from 34 to 38% of Ni, up to 0.5% of Mn, from 0 to 0.02% of soluble Al, from 0.0030 to 0.0100% of N, the balance being Fe and unavoidable impurities, in which the smaller of the first value, which is the content of said soluble Al content divided by 27, or the second value, which is the nitrogen content divided by 14, is not more than 0.00015, and in which, when the first value and the second value are the same, the content of soluble Al is from 0 to 0.01%.

There is also provided a shadow mask consisting of an Fe-Ni alloy sheet bent by a press forming to shape conforming to the shape of the panel of a Braun tube, and having apertures formed by photoetching through which an electron beam passes, said alloy consisting of, by weight percentage, from 34 to 38% of Ni, up to 0.5% of Mn, from 0 to 0.02% of soluble Al, from 0.0030 to 0.0100% of N, the balance being Fe and unavoidable impurities, in which alloy the smaller of the first value, which is the content of said soluble Al content divided by 27, or the second value, which is the nitrogen content divided by 14, is not more than 0.00015, and in which, when the first value and the second value are the same, the content of soluble Al is from 0 to 0.01%.

There is further provided a method for producing an Fe-Ni alloy used for a shadow mask comprising the steps of:

preparing a sheet of an Fe-Ni alloy consisting of, by weight percentage, from 34 to 38% of Ni, up to 0.5% of Mn, not more than 0.02% of soluble Al, from 0.0030 to 0.0100% of N, the balance being Fe and unavoidable impurities, in which alloy the smaller of the first value, which is the content of said soluble Al content divided by 27, or the second value, which is the nitrogen content divided by 14, is not more than 0.00015, and in which, when the first value and the second value was the same, the content of soluble Al is from 0 to 0.01%;

photo-etching said sheet;

annealing said sheet at a temperature of 800° C. or more; and, bending said annealed sheet to the form of the shadow mask.

The present invention is described hereinafter in detail.

The soluble Al herein is the solute Al dissolved in the matrix of an Fe-Ni alloy and is distinguished from the insoluble Al which is present as inclusion such as oxide inclusions. The content of soluble Al is analyzed by: dissolving Fe-Ni alloy in hydrochloric acid or a mixture hydrochloric acid and nitric acid, and subjecting the filtrated liquid to analysis by the ion-coupled plasma activated Auger electron spectroscopy (ICP-AES method). The insoluble Al can be analyzed by dissolving the filtration residue by aqueous sodium peroxide solution and then to the ICP-AES method.

The etching property is influenced by the soluble Al. In addition, the annealing softening property is succeptible to change by the lower content of the soluble Al content and the N content.

The stoichiometric amounts determining the amount of aluminum nitride (AlN) are the first value, which is the soluble Al content divided by the atomic number of Al, i.e., 27, and the second value, which is the nitrogen content divided by the atomic number of N, i.e., 14. When the first value is greater than the second value, the soluble Al may remain in the matrix of the Fe-Ni alloy and the amount of AlN is determined by the second value. When the first value is smaller than the second value, the unfixed N may remain in the matrix and the amount of AlN is determined by the first value. The annealing softening property is influenced by the smaller of the first and second values, which is preferably 0.0001% or less. In other words, these values, which determine the amount of AlN, exert influence upon the annealing softening property.

In a case, where the first and second values are equal, neither soluble Al nor unfixed N may remain in the matrix of the Fe-Ni alloy. When the first and second values are equal, the formation of AlN should be suppressed to an extremely low level. The soluble aluminum content is preferably from 0 to 0.01% by weight.

DESCRIPTION OF PREFERRED EMBODIMENTS

Figure 4:
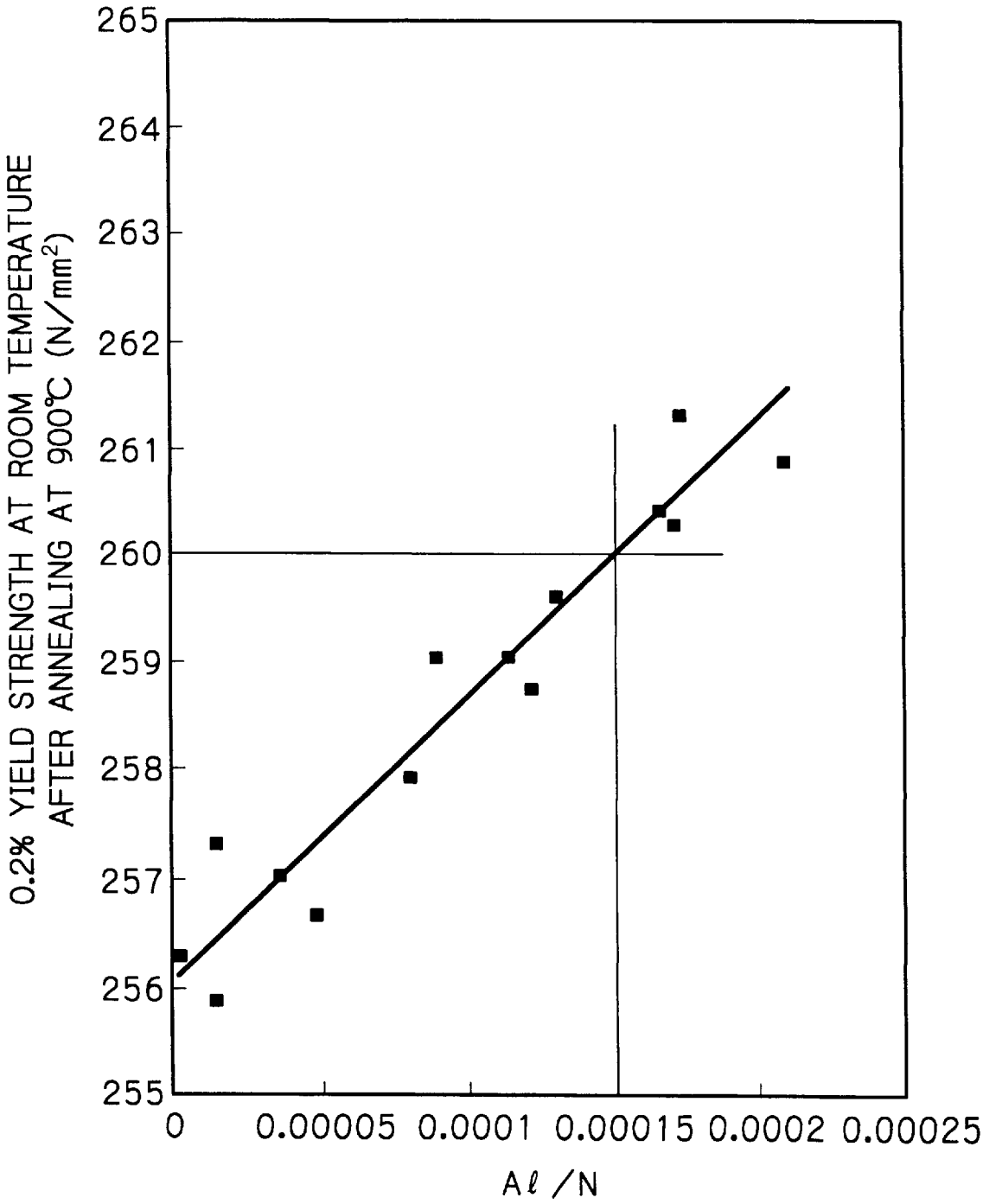
FIG. 4 is a graph showing the relationship between the smaller value of the first value (soluble Al) content (weight %) divided by 27) and the second value (N content (weight %) divided by 14) and the 0.2% yield strength.

Fe-35–37% Ni alloys with various soluble Al and N contents were annealed at 900° C. for 15 minutes in the 8% $H_2$92% $N_2$ atmosphere and then subjected to tensile test at room temperature. Relationships between the smaller of the first and second values and the 0.2% yield strength are shown in FIG. 4. Such smaller value is denoted in FIG. 4 as Al/N. As is shown in FIG. 4, the 0.2% yield strength of Fe-Ni alloy increases almost linearly with the increase in Al/N. Meanwhile, it has been clarified by the present inventors that, when an Fe-Ni alloy sheet for a shadow mask is formed by pressing, spring-back of the sheet is prevented from occurring and press formability is excellent under almost all press-forming conditions, provided that the sheet has 260 N/mm$^2$ or less of 0.2% yield strength. The annealing at 900° C. of an Fe-Ni alloy sheet having 0.00015 or less of Al/N softens the sheet so that it has 260 N/mm$^2$ or less of 0.2% yield strength as shown in FIG. 4. Meanwhile, the content of insoluble Al exerts no influence upon the annealing softening property.

Preferable contents of soluble Al and N for further improving the annealing softening property are now described. When the first value (soluble Al) is smaller than the second value (N content), the N content need not be strictly controlled, because the free N improves the etching property. However, the soluble Al content is preferably 0.01% or less, so as not to increase the amount of AlN.

As is described hereinabove, since the etching property is improved by N, the first value (soluble Al) is preferably less than the second value (N), thereby keeping the amount of unfixed N to a high level. Evidently, the nitrogen, which improves the etching property, is neither $N_2$ contained in the blow holes nor is it in the form of AlN inclusions.

The composition of the Fe-Ni alloy is described in detail hereinafter. The percentage of the composition below is based on weight.

Nitrogen (N)

Figure 1:
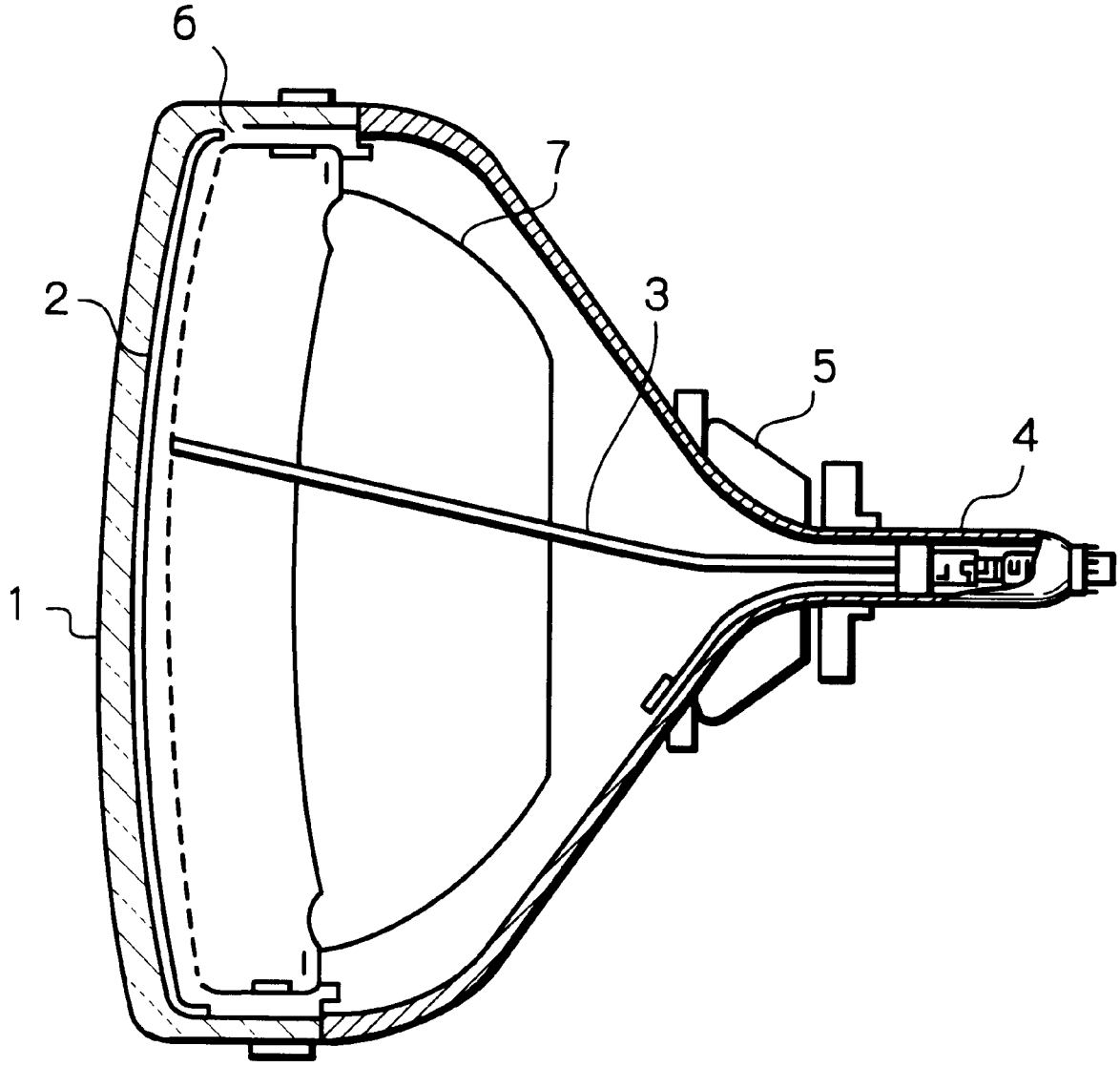
Fig. 1 PRIOR ART
FIG. 1 is a cross-sectional of the known shadow-mask type color cathode-ray tube.
Figure 2:
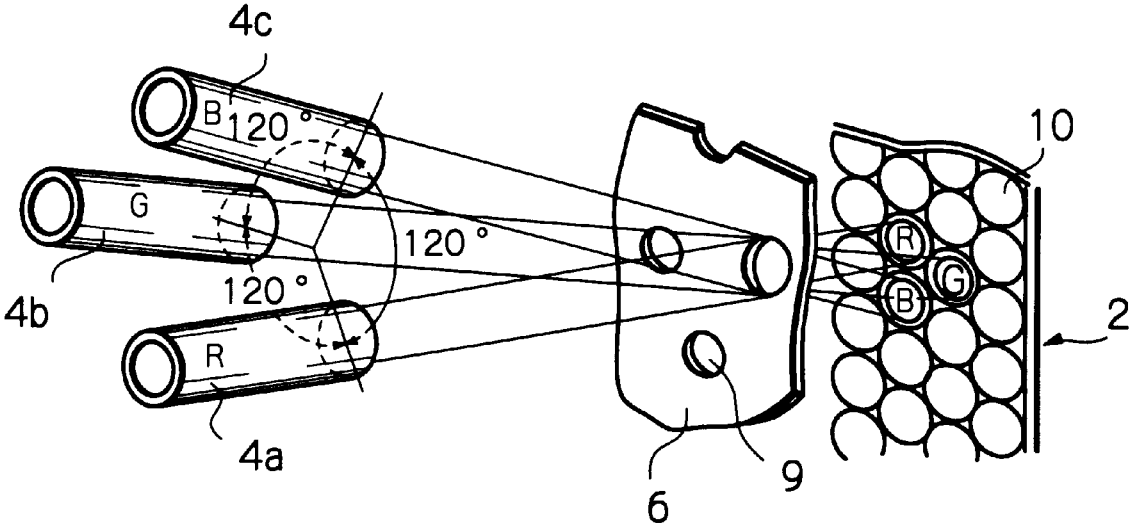
Fig. 2 PRIOR ART
FIG. 2 is an enlarged partial view of a shadow mask.
Figure 3:
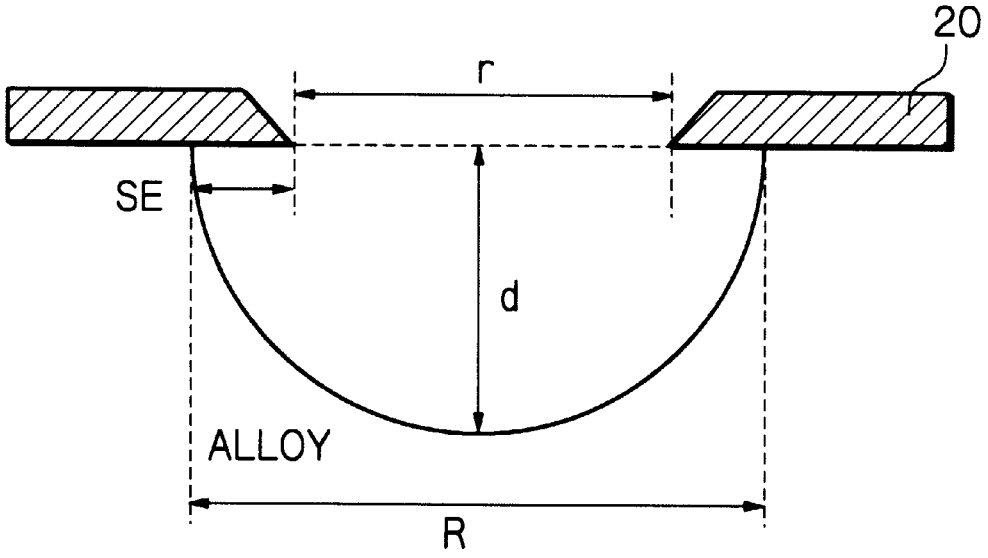
FIG. 3 is a drawing illustrating the etching factor (EF).

The N improves the etching property in terms of the etching factor (EF) illustrated in FIG. 3, with the increase in the N content. The etching factor (EF) is defined by d/SE, in which "d" and "SE" indicate the depth of the etched hole and the amount of side etching, respectively. Reference numeral 20 denotes a photoresist, the aperture of which has a diameter "r". The Fe-Ni alloy is selectively etched using the photoresist 20 to form an aperture having radius depth "d" and radius "R".

When the N content is less than 0.003% by weight, the etching property is unsatisfactory. On the other hand, when the nitrogen content is more than 0.01%, the nitrile inclusions, which are detrimental to the annealing softening property, are liable to form greatly. In addition, blow holes due to $N_2$ gas are liable to form in an ingot. When such ingot is rolled into a sheet, blisters, which are swelling on the surface, are liable to form. The N content is, therefore, from 0.003 to 0.01%.

Soluble Al

Aluminum is added as a deoxidizing agent, when the Fe-Ni alloy is melted. The soluble Al is not the deoxidizing product but is solute Al dissolved in the matrix of the alloy. When the soluble Al is more than 0.02%, the etching property is impaired. The soluble Al may be zero %, that is, no aluminum is added, or all of the aluminum added is combined with oxygen and the like. The soluble Al is, therefore, from zero to 0.02%.

Manganese (Mn)

The etching property is further improved with lower Mn content. Mn advantageously forms, however, manganese sulfide with S which element impairs the hot workability and corrosion resistance. The etching property is maintained at a satisfactory level when the Mn content is 0.5% or less, more particularly 0.05% or less.

The melting methods of the Fe-Ni alloy according to the present invention are now described.

Materials, such as iron, nickel and manganese, are melted in a vacuum induction furnace. These materials having high purity are selected for melting. When the removal of such impurities as carbon, phosphorus and sulfur is necessary, the ladle refining is carried out.

Decrease of the oxygen content in the Fe-Ni alloy is proposed in Japanese Unexamined Patent Publication No.

7-48,651 mentioned above. Contrary to this, since the soluble Al content may be zero in the present invention, the deoxidization by aluminum may not be necessary. When the deoxidization is necessary, aluminum is added at the final stage of melting. Furthermore, when the aluminum is to be added to the Fe-Ni alloy to remain unoxidized as the soluble Al, the aluminum is also added at the final stage.

The nitrogen is added to the Fe-Ni alloy melt by means of introducing nitrogen gas into the melting vessel and above the surface of the melt bath. The ratio of the first value (soluble Al) to the second value (N) is adjusted by means of adjusting the relative amount of addition of aluminum to the $N_2$ partial pressure in the melting environment. Manganese is added to the melt in the final stage, because the vapor pressure of Mn is high.

The Fe-Ni alloy melted as described above may be cast into a mold to produce an ingot or may be continuously cast to form a slab.

The processing of the Fe-Ni alloy according to the present invention is now described.

The Fe-Ni alloy can be forged or not-rolled. The forced cooling after hot-rolling as proposed in Japanese Unexamined Patent Publication No. 9-324,244 is not necessary in the present invention. In order to form a sheet with the required thickness for the shadow mask, the forged or rolled material is repeatedly cold-rolled and annealed. The intermediate annealing between the cold-rolling steps is preferably carried out at a temperature of 800° C. or more, particularly 900° C. or more. After the final cold rolling, the rolled sheet may be subjected to correction of shape and stress-relief annealing.

The Fe-Ni alloy sheet according to the present invention may have such anisotropy that the etching factor (EF) is dependent upon the rolling direction, that is, the etching factor (EF) in the rolling direction is different from that in the direction of an angle of 45° to the rolling direction. Such anistropy can be lowered by adjusting the rolling degree in range of from 50% to less than 85%.

The present invention is hereinafter described with reference to the examples and the comparative examples.

EXAMPLES

Pure iron, pure nickel and pure manganese were used as the main starting materials. Aluminum was used as the deoxidizing agent and was melted together with the main starting materials. These materials were melted in a vacuum melting furnace. Samples Nos. 1 through 6 and Nos. 9 through 15 were melted in vacuo. Subsequently, nitrogen gas was introduced in the vacuum melting furnace so that the pressure the furnaceinterior reaches at 1–300 torr. Under such pressure the melt was held for 1 to 30 minutes, so as to control the N content. The pressure was then decreased to 0.5 torr, followed by pouring the melt as an ingot. In the case of melting the Samples Nos. 7 and 8, the melting was carried out under vacuum, and, directly before casting, argon gas was introduced into the vacuum melting furnace to provide 0.5 torr of furnace interior pressure.

The ingots were successively forged, descaled, hot-rolled, and desccaled. By means of repeating cold-rolling and intermeidate annealing, 0.15 mm thick alloy-sheets were produced. The 13B type tensile-strength specimens were punched from the alloy sheets and were annealed at 700° C., 800° C. or 900° C. for 15 minutes in a furnace under 8% by volume of $H_2$-92% by volume of $N_2$. After annealing, the furnace cooling was carried out down to 200° C., followed by withdrawing the specimens from the furnace and then non-forcibly cooling in ambient atmosphere down to room temperature. The 0.2% yield strength was then measured.

In Table 1, the composition of samples is shown.

TABLE 1

| | Chemical Components (wt %) | | | | |
|---|---|---|---|---|---|
| No. | C | Si | Mn | Ni | O |
| 1 | 0.003 | 0.008 | 0.32 | 35.5 | 0.0028 |
| 2 | 0.004 | 0.007 | 0.32 | 35.8 | 0.0035 |
| 3 | 0.003 | 0.008 | 0.31 | 36.1 | 0.0029 |
| 4 | 0.003 | 0.008 | 0.27 | 36.2 | 0.0037 |
| 5 | 0.002 | 0.008 | 0.28 | 35.7 | 0.0028 |
| 6 | 0.004 | 0.002 | 0.25 | 35.7 | 0.0032 |
| 7 | 0.005 | 0.005 | 0.26 | 35.6 | 0.0026 |
| 8 | 0.005 | 0.005 | 0.27 | 35.9 | 0.0041 |
| 9 | 0.003 | 0.007 | 0.28 | 36.2 | 0.0035 |
| 10 | 0.004 | 0.009 | 0.25 | 36.7 | 0.0028 |
| 11* | 0.003 | 0.010 | 0.31 | 36.5 | 0.0028 |
| 12* | 0.003 | 0.008 | 0.29 | 36.4 | 0.0036 |
| 13* | 0.004 | 0.009 | 0.28 | 36.2 | 0.0027 |
| 14* | 0.003 | 0.012 | 0.26 | 35.8 | 0.0041 |
| 15* | 0.002 | 0.011 | 0.25 | 35.8 | 0.0031 |

Remarks. The asterisked samples are comparative, and the non-asterisked samples are inventive.

In Table 2, the N and soluble Al contents, the first value (soluble Al), the second value (N), and the smaller of the first and second values, and the 0.2% yield strength after annealing at the respective temperature are shown.

As is clear from Table 2 and FlG. 4, the inventive examples having 0.00015 or less of (Al/N) exhibit less than 260 N/mm$^2$ or less of the 0.2% yield strength and hence improved press-formability. Contrary to this, the 0.2% yield strength of the comparative examples exceed 260 N/mm$^2$.

The correlation coefficient between the 0.2% yield strength and the (Al/N) at 700° C., 800° C. and 900° C. of the annealing temperature is 0.37, 0.93 and 0.96, respectively. Therefore, when the annealing temperature is 800° C. or more, the correlation coefficient is in the proximity of 1. This indicates a positive correlation between the 0.2% yield strength and (Al/N). The increase or decrease of A/N leads, therefore, to increase or decrease of the 0.2% yield strength in most cases. Therefore, the 0.2% yield strength can be lowered and hence the press formability can be improved by enhancing the annealing temperature or by decreasing Al/N.

TABLE 2

| Sample | N Content | | Sol-Al content | | Smaller | 0.2% yield strength (N/mm$^2$) at room temperature after annealing at 700–800° C. | | |
|---|---|---|---|---|---|---|---|---|
| Nos. | (wt %) | 1st Value | (wt %) | 2nd Value | Value | 700° C. | 800° C. | 900° C. |
| 1 | 0.0018 | $1.285 \times 10^{-4}$ | 0.0001 | $3.7 \times 10^{-6}$ | $3.7 \times 10^{-6}$ | 281.5 | 268.4 | 256.3 |
| 2 | 0.0018 | $1.285 \times 10^{-4}$ | 0.0004 | $1.48 \times 10^{-5}$ | $1.48 \times 10^{-5}$ | 285.2 | 267.3 | 255.9 |
| 3 | 0.0019 | $1.375 \times 10^{-4}$ | 0.0004 | $1.48 \times 10^{-5}$ | $1.48 \times 10^{-5}$ | 283.2 | 265.2 | 257.3 |

TABLE 2-continued

| Sample Nos. | N Content (wt %) | 1st Value | Sol-Al content (wt %) | 2nd Value | Smaller Value | 0.2% yield strength (N/mm$^2$) at room temperature after annealing at 700–800° C. 700° C. | 800° C. | 900° C. |
|---|---|---|---|---|---|---|---|---|
| 4 | 0.0021 | $1.5 \times 10^{-4}$ | 0.0030 | $1.111 \times 10^{-4}$ | $1.111 \times 10^{-4}$ | 284.5 | 270.7 | 259.0 |
| 5 | 0.0020 | $1.428 \times 10^{-4}$ | 0.0013 | $4.81 \times 10^{-5}$ | $4.81 \times 10^{-5}$ | 287.3 | 268.0 | 256.6 |
| 6 | 0.0022 | $1.571 \times 10^{-4}$ | 0.0024 | $8.88 \times 10^{-5}$ | $8.88 \times 10^{-5}$ | 283.0 | 270.0 | 259.0 |
| 7 | 0.0005 | $3.57 \times 10^{-5}$ | 0.0110 | $4.074 \times 10^{-4}$ | $3.57 \times 10^{-5}$ | 284.3 | 267.1 | 257.0 |
| 8 | 0.0011 | $7.85 \times 10^{-5}$ | 0.0038 | $1.407 \times 10^{-4}$ | $7.85 \times 10^{-5}$ | 286.0 | 269.4 | 257.9 |
| 9 | 0.0017 | $1.214 \times 10^{-4}$ | 0.0079 | $2.925 \times 10^{-4}$ | $1.214 \times 10^{-4}$ | 284.0 | 268.8 | 258.7 |
| 10 | 0.0018 | $1.285 \times 10^{-4}$ | 0.0140 | $5.185 \times 10^{-4}$ | $1.285 \times 10^{-4}$ | 283.6 | 270.1 | 259.5 |
| 11 | 0.0023 | $1.642 \times 10^{-4}$ | 0.0120 | $4.444 \times 10^{-4}$ | $1.642 \times 10^{-4}$ | 287.1 | 274.2 | 260.4 |
| 12 | 0.0024 | $1.714 \times 10^{-4}$ | 0.0045 | $1.666 \times 10^{-4}$ | $1.666 \times 10^{-4}$ | 284.2 | 273.5 | 260.2 |
| 13 | 0.0024 | $1.714 \times 10^{-4}$ | 0.0150 | $5.555 \times 10^{-4}$ | $1.714 \times 10^{-4}$ | 284.7 | 273.2 | 261.2 |
| 14 | 0.0028 | $2.0 \times 10^{-4}$ | 0.0080 | $2.962 \times 10^{-4}$ | $2.0 \times 10^{-4}$ | 285.1 | 274.1 | 262.0 |
| 15 | 0.0029 | $2.071 \times 10^{-4}$ | 0.0150 | $5.555 \times 10^{-4}$ | $2.071 \times 10^{-4}$ | 286.3 | 274.5 | 260.8 |

What is claimed is:

1. An Fe-Ni alloy used for a shadow mask, consisting of, by weight percentage, from 34 to 38% of Ni, up to 0.5% of Mn, from 0 to 0.02% of soluble Al, from 0.0005 to 0.0100% of N, the balance being Fe and unavoidable impurities, in which a smaller of a first value, which is the content of said soluble Al content divided by 27, or a second value, which is the nitrogen content divided by 14, is not more than 0.0000888, and in which when the first value and the second value are the same, the content of the soluble Al is from 0 to 0.01%, and said Fe-Ni alloy exhibiting a 0.2% yield strength (N/mm$^2$) of 260 N/mm$^2$ or less at room temperature after annealing at 900° C.

2. An Fe-Ni alloy according to claim 1, wherein the first value is less than the second value.

3. An Fe-Ni alloy according to claim 1, wherein the second value is less than the first value.

4. An Fe-Ni alloy according to claim 2, wherein the second value is 0.00010% or less.

5. An Fe-Ni alloy according to claim 1, wherein said alloy is annealed at a temperature of 800° C. or more.

6. A shadow mask consisting of an Fe-Ni alloy sheet bent by press forming to a shape of a panel of a Braun tube after etching, wherein said Fe-Ni alloy consists of, by weight percentage, from 34 to 38% of Ni, up to 0.05% of Mn, from 0 to 0.02% of soluble Al, from 0.0005 to 0.0100% of N, the balance being Fe and unavoidable impurities, in which a smaller of a first value, which is the content of said soluble Al content divided by 27, or a second value, which is the nitrogen content divided by 14, is not more than 0.0000888, and in which when the first value and the second value are the same, the content of the soluble Al is from 0 to 0.01%.

7. A shadow mask according to claim 6, wherein the first value is less than the second value.

8. A shadow mask according to claim 7, wherein the first value is 0.00010% or less.

9. A shadow mask according to claim 6, wherein the second value is less than the first value.

10. A shadow mask according to claim 6, wherein said alloy is annealed at a temperature of 800° C. or more.

11. A method for producing a shadow mask comprising the steps of:

preparing a sheet of an Fe-Ni alloy consisting of, by weight percentage, from 34 to 38% of Ni, up to 0.5% of Mn, from 0 to 0.02% of soluble Al, from 0.0005 to 0.0100% of N, the balance being Fe and unavoidable impurities, in which a smaller of a first value, which is the content of said soluble Al content divided by 27, or a second value, which is the nitrogen content divided by 14, is not more than 0.00015, and in which, when the first value and the second value are the same, the content of the soluble Al is from 0 to 0.01%;

photo-etching said sheet to form apertures;

annealing said sheet at a temperature of 800° C. or more; and bending the annealed sheet to a shape conforming to a panel of a Braun tube.

12. A method according to claim 11, wherein said preparation step of a sheet comprising the steps of:

melting said alloy in a vacuum melting furnace;

casting an alloy melt into an ingot or a slab; and, cold-rolling said ingot or slab.

13. A method according to claim 11, wherein the first value is less than the second value.

14. A method according to claim 11, wherein the second value is less than the first value.

* * * * *